US007088244B2

(12) United States Patent
Kimura

(10) Patent No.: US 7,088,244 B2
(45) Date of Patent: Aug. 8, 2006

(54) COMMUNICATION SYSTEM

(75) Inventor: Makoto Kimura, Tokyo (JP)

(73) Assignee: Mediagram Inc., Tokyo (JP)

( * ) Notice: Subject to any disclaimer, the term of this patent is extended or adjusted under 35 U.S.C. 154(b) by 117 days.

(21) Appl. No.: 10/882,628

(22) Filed: Jul. 2, 2004

(65) Prior Publication Data

US 2005/0035873 A1 Feb. 17, 2005

(30) Foreign Application Priority Data

Jul. 4, 2003 (JP) ..... 2003-271026

(51) Int. Cl.
*G08B 13/14* (2006.01)

(52) U.S. Cl. ..... 340/572.1; 340/572.4; 340/539.1; 340/539.13; 340/539.23; 340/825.69

(58) Field of Classification Search ..... 340/572.1, 340/572.4, 572.7, 572.8, 539.1, 539.13, 539.23, 340/686.1, 825.49, 825.69, 10.1, 10.3; 235/383, 235/385

See application file for complete search history.

(56) References Cited

U.S. PATENT DOCUMENTS 5,258,977 A * 11/1993 Wolker et al. ..... 370/395.2
5,530,702 A * 6/1996 Palmer et al. ..... 370/445
6,563,417 B1 * 5/2003 Shaw ..... 340/10.1
6,714,121 B1 * 3/2004 Moore ..... 340/10.3

FOREIGN PATENT DOCUMENTS

JP 2002-374582 12/2002
JP 2003-37604 2/2003
JP 2003-47078 2/2003

* cited by examiner

*Primary Examiner*—Hung Nguyen
(74) *Attorney, Agent, or Firm*—Wenderoth, Lind & Ponack, L.L.P.

(57) ABSTRACT

A communication system comprises at least one first wireless tag for identifying a first apparatus location area, at least one second wireless tag for identifying a second apparatus location area, a transmitter, and a receiver. The transmitter, when residing in the first or second apparatus location area, outputs a wireless ID read signal to read the ID of the wireless tag in the area, multiplexes the read ID on a communication signal, and transmits the resultant communication signal. The receiver, when residing in the second or first apparatus location area, outputs a wireless ID read signal to read the ID of the wireless tag in the area, determines whether or not an ID identical to the read ID is multiplexed on a received communication signal, and determines that the communication signal is addressed to the receiver itself when the ID is multiplexed.

47 Claims, 10 Drawing Sheets

COMMUNICATION SYSTEM

BACKGROUND OF THE INVENTION

The present invention generally relates to a communication system, and more particularly to a communication system which allows only an intended destination to appropriately receive a communication signal such as a control signal, a data signal, and so on.

A remote control system using radio communication technologies occasionally needs to make settings to enable a particular control apparatus (or initiator) to remotely control a target apparatus, and to disable other control apparatuses to remotely control the target apparatus. In such a case, as described in the following References 1 and 2, a control apparatus multiplexes in a control signal an ID signal for identifying a target apparatus, and transmits the resulting multiplexed signal, while the target apparatus obtains the control signal multiplexed with the own ID signal from received signals, and performs a control operation in accordance with the control signal.

The following Reference 3 describes a system for grouping apparatuses such as transmitters and receivers connected to a network. In this system, when an apparatus receives an infrared signal, the apparatus sends a signal to a control unit which communicates with other apparatuses, and the control unit determines on the basis of the signal received from the apparatus which group the apparatus belongs to, thereby enabling the apparatuses within the group to communicate.

Reference 1: Japanese Patent Public Disclosure No. 2003-47078

Reference 2: Japanese Patent Public Disclosure No. 2002-374582

Reference 3: Japanese Patent Public Disclosure No. 2003-37604

However, in the remote control systems described in References 1 and 2, it is necessary to preset an ID of each target apparatus for control in both a control apparatus and the target apparatus. Therefore, if a combination of a control apparatus with a target apparatus is relatively frequently changed, an ID must be set in the control apparatus and target apparatus each time the combination is changed. Also, even if a combination of a control apparatus with a target apparatus is fixed, when the control apparatus (or the target apparatus) is replaced with another one, the ID must be set again in the new control apparatus (or new target apparatus). Since repeated setting of an ID is time-consuming for an operator to perform, a need exists for a method of simply and automatically setting an ID each time a control apparatus or a target apparatus is replaced with another one.

The foregoing problem holds true not only in a remote control system comprised of control apparatuses and target apparatuses, but also in a general wired communication system and wireless communication system comprised of transmitters and receivers which communicate signals such as data in which an ID is multiplexed.

Therefore, in the following description, the terms "transmitter" and "receiver" refer to apparatuses for carrying out communications to each other, which include a "control apparatus (or initiator)" and a "target apparatus", and the term "a communication system" refers to a wired or wireless system for carrying out communications, which includes a "remote control system."

Further, in the system described Reference 3, apparatuses must communicate with one another to recognize those apparatuses which belong to the same group.

SUMMARY OF THE INVENTION

The present invention has been made to solve the aforementioned problems of the prior arts, and it is an object of the invention to provide a communication system for transmitting a communication signal sent from at least one transmitter to at least one receiver, wherein a communication signal from a transmitter is received only by an intended receiver without pre-stored IDs fixedly assigned to respective transmitters and receivers.

To achieve the above object, in a first aspect of the present invention, a communication system is provided which allows only an intended receiver(s) to receive a communication signal from a transmitter(s) in an environment in which a plurality of receivers are capable of receiving a communication signal transmitted from the transmitter, the communication system comprising:

at least one first wireless tag for defining a first apparatus location area, the first wireless tags storing an ID;

at least one second wireless tag for defining a second apparatus location area, the second wireless tag storing the same ID as the ID stored in the first wireless tag in the first apparatus location area;

a transmitter comprising reading means for outputting a wireless ID read signal to read out the ID of the first or second wireless tag when the transmitter resides in the first or second apparatus location area, and means for multiplexing the read ID on a communication signal and transmitting the resultant communication signal; and a receiver comprising reading means for outputting a wireless ID read signal to read the ID of the second or first wireless tag when the receiver resides in the second or first apparatus location area, means for determining whether or not an ID identical to the read ID is multiplexed on a received communication signal, and means for determining that the communication signal is addressed to the receiver when it is determined that the ID identical to the read ID is multiplexed on the transmission signal, whereby a signal from the transmitter residing in one of the first and second apparatus location areas can be received by the receiver residing in the other apparatus location area.

To achieve the above object, in a second aspect of the present invention, a communication system is provided which allows only an intended receiver(s) to receive a communication signal from a transmitter(s) in an environment in which a plurality of receivers are capable of receiving a communication signal transmitted from the transmitter, the communication system comprising:

at least one first active wireless tag for defining a first apparatus location area, the first active wireless tag storing an ID and actively outputting the ID;

at least one second active wireless tag for defining a second apparatus location area, the second active wireless tag storing the same ID as the ID stored in the first active wireless tag in the first apparatus location area, and actively outputting the ID;

a transmitter comprising reading means for collecting the ID output from the first or second active wireless tag when the transmitter resides in the first or second apparatus location area, and means for multiplexing the read ID on a communication signal and transmitting the resultant communication signal; and a receiver comprising reading means for outputting a wireless ID read signal to read the IDs from the second or first wireless tag, means for determining whether or not an ID identical to the read ID is multiplexed on a received communication signal, and means for determining that the communication signal is addressed to the receiver when it is determined that the ID identical to the read ID is multiplexed on the received communication signal, whereby a signal from the transmitter residing in one of the first and second apparatus location areas can be received by the receiver residing in the other apparatus location area.

In the communication system according to the first aspect of the present invention, it is preferable that the first apparatus location area is defined by a plurality of the first wireless tags, each of which stores a different ID, and the second apparatus location area is defined by a plurality of the second wireless tags, each of which stores the same ID as one of the IDs stored in the plurality of first wireless tags. In this preferred implementation, at least one of the first wireless tags may be common to at least one of the second wireless tags, so that the first apparatus location area at least partially overlaps with the second apparatus location area. These matters relating to the wireless tags are also applied to the active wireless tags in the communication system according to the second aspect of the present invention.

To achieve the above object, in a third aspect of the present invention, a communication system is provided which allows only an intended receiver(s) to receive a communication signal from a transmitter(s) in an environment in which a plurality of receivers are capable of receiving a communication signal transmitted from the transmitter, the communication system comprising:

a plurality of first wireless tags for defining a first apparatus location area, and a plurality of second wireless tags for defining a second apparatus location area, each of the first and second wireless tags storing ID information provided according to the FEC coding, the ID information being of an ID segment comprised of one or a plurality of divided sections produced by dividing a predetermined ID;

a transmitter comprising reading means for outputting a wireless ID read signal to read the ID information from each of the first or second wireless tags when the transmitter resides in the first or second apparatus location area, means for decoding the original ID from the read ID information, and means for multiplexing the decoded ID on a communication signal and transmitting the resultant communication signal; and a receiver comprising reading means for outputting a wireless ID read signal to read ID information from each of the second or first wireless tags when the receiver resides in the second or first apparatus location area, means for decoding the original ID from the read ID information, means for determining whether or not an ID identical to the decoded ID is multiplexed on a received communication signal, and means for determining that the communication signal is addressed to the receiver when the ID identical to the decoded ID is multiplexed on the received communication signal, whereby a signal from the transmitter residing in one of the first and second apparatus location areas can be received by the receiver residing in the other apparatus location area.

To achieve the above object, in the fourth aspect of the present invention, a communication system which allows only an intended receiver(s) to receive a communication signal from a transmitter(s) in an environment in which a plurality of receivers are capable of receiving a communication signal transmitted from the transmitter, the communication system comprising:

a plurality of first active wireless tags for defining a first apparatus location area, and a plurality of second active wireless tags for defining a second apparatus location area, each of the first and second active wireless tags storing ID information and actively outputting the stored ID information, the ID information being provided according to the FEC coding, and being of an ID segment comprised of one or a plurality of divided sections produced by dividing a predetermined ID;

a transmitter comprising reading means for collecting the ID information from the first or second active wireless tags when the transmitter resides in the first or second apparatus location area, means for decoding the original ID from the collected ID information, and means for multiplexing the decoded ID on a communication signal and transmitting the resultant communication signal; and a receiver including reading means for collecting ID information from the second or first active wireless tags when the receiver resides in the second or first apparatus location area, means for decoding the original ID from the collected ID information, means for determining whether or not an ID identical to the decoded ID is multiplexed on a received communication signal, and means for determining that the communication signal is addressed to the receiver when it is determined that the ID identical to the decoded ID is multiplexed on the received communication signal, wherein a signal from the transmitter residing in one of the first and second apparatus location areas can be received by the receiver residing in the other apparatus location area.

To achieve the above object, in the fifth aspect of the present invention, a communication system is provided which allows only an intended receiver(s) to receive a communication signal from a transmitter(s) in an environment in which a plurality of receivers are capable of receiving a communication signal transmitted from the transmitter, the communication system comprising:

a plurality of first wireless tags for defining a first apparatus location area, and a plurality of second wireless tags for defining a second apparatus location area, each of the first and second wireless tags storing ID information provided according to the FEC coding, the ID information being of an ID segment comprised of one or a plurality of divided sections produced by dividing a predetermined ID;

a transmitter comprising reading means for outputting a wireless ID read signal to read the ID information of the first or second wireless tags when the transmitter resides in the first or second apparatus location area, and means for multiplexing the read ID information on a communication signal and transmitting the resultant communication signal; and a receiver comprising reading means for outputting a wireless ID read signal to read ID information of the second or first wireless tags when the receiver resides in the second or first apparatus location area, first decoding means for decoding an original ID from the read ID information, second decoding means for decoding the original ID using some of the read ID information and the ID information multiplexed on a received communication signal, means for determining whether or not the ID decoded by the first decoding means is identical to the ID decoded by the second decoding means, and means for determining that the communication signal is addressed to the receiver when the determining means determines that the two IDs are identical, whereby a signal from the transmitter residing in one of the first and second apparatus location areas can be received by the receiver residing in the other apparatus location area.

To achieve the above object, in the sixth aspect of the present invention, a communication system is provided which allows only an intended receiver(s) to receive a communication signal(s) from a transmitter(s) in an environment in which a plurality of receivers are capable of receiving a communication signal transmitted from the transmitter, the communication system comprising:

a plurality of first active wireless tags for defining a first apparatus location area, and a plurality of second active wireless tags for defining a second apparatus location area, each of the first and second active wireless tags storing ID information provided according to the FEC coding and actively outputting the ID information, the ID information being of an ID segment comprised of one or a plurality of divided sections produced by dividing a predetermined ID;

a transmitter comprising means for collecting the ID information from the first or second active wireless tags when the transmitter resides in the first or second apparatus location area, and means for multiplexing the collected ID information on a communication signal and transmitting the resultant communication signal; and a receiver comprising means for collecting ID information from the second or first active wireless tags when the receiver resides in the second or first apparatus location area, first decoding means for decoding the original ID from the collected ID information, second decoding means for decoding the original ID using some of the collected ID information and ID information multiplexed on a received communication signal, means for determining whether or not the ID decoded by the first decoding means is identical to the ID decoded by the second decoding means, and means for determining that the communication signal is addressed to the receiver when it is determined that the two IDs are identical, whereby a signal from the transmitter residing in one of the first and second apparatus location areas can be received by the receiver residing in the other apparatus location area.

In the communication systems according to the third to fifth aspects of the present invention, at least one of the first wireless tags may be common to at least one of the second wireless tags, so that the first apparatus location area at least partially overlaps with the second apparatus location area. This matter relating to the wireless tags is also applied to the active wireless tags in the communication systems according to the fourth and sixth aspects of the present invention.

In the communication systems according to the first, third, and fifth aspects of the present invention, it is preferable that the ID read signal output from the reading means of the respective transmitter and receiver is an infrared signal, an ultrasonic signal, or a radiowave signal, and the signal-has a low field intensity.

Also, in the communication system according to the present invention, the wireless tag is preferably configured to output its own ID or ID segment in the form of an infrared signal, an ultrasonic signal, or a radiowave signal, and the signal-has a low field intensity, whereas the communication signal from the transmitter to the receiver is preferably a wireless communication signal.

Further, in the communication system according to the present invention, it is preferable that the transmitter and the receiver are a control apparatus and a target apparatus, or personal computers.

DETAILED DESCRIPTION OF THE INVENTION

Figure 1A:
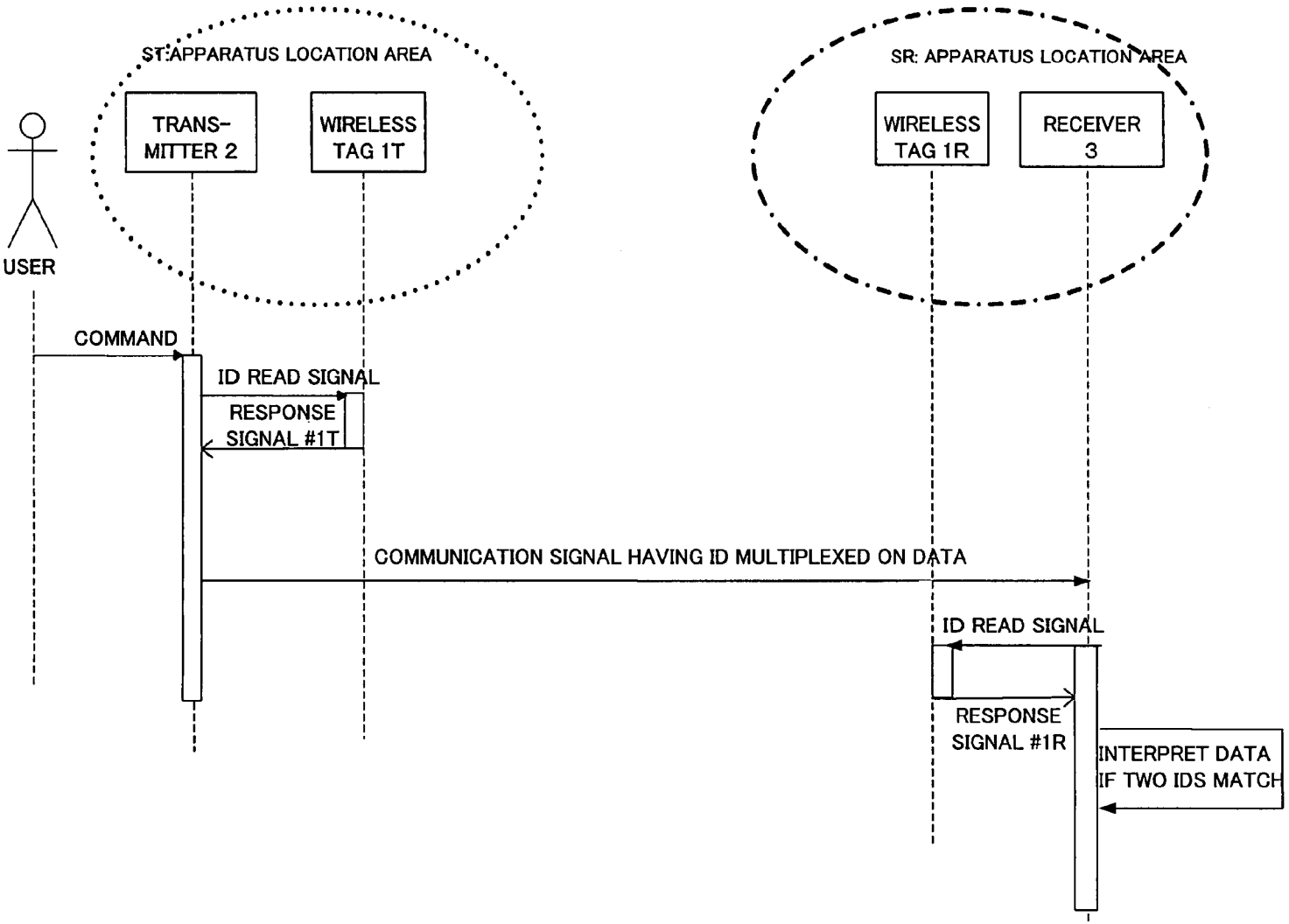
FIG. 1A is a block diagram for illustrating a communication system according to a first embodiment of the present invention.

In the following, preferred embodiments of the present invention will be described with reference to the accompanying drawings. It is to be noted that in this specification and drawings, like components are denoted by like reference numerals or symbols.

Figure 1B:
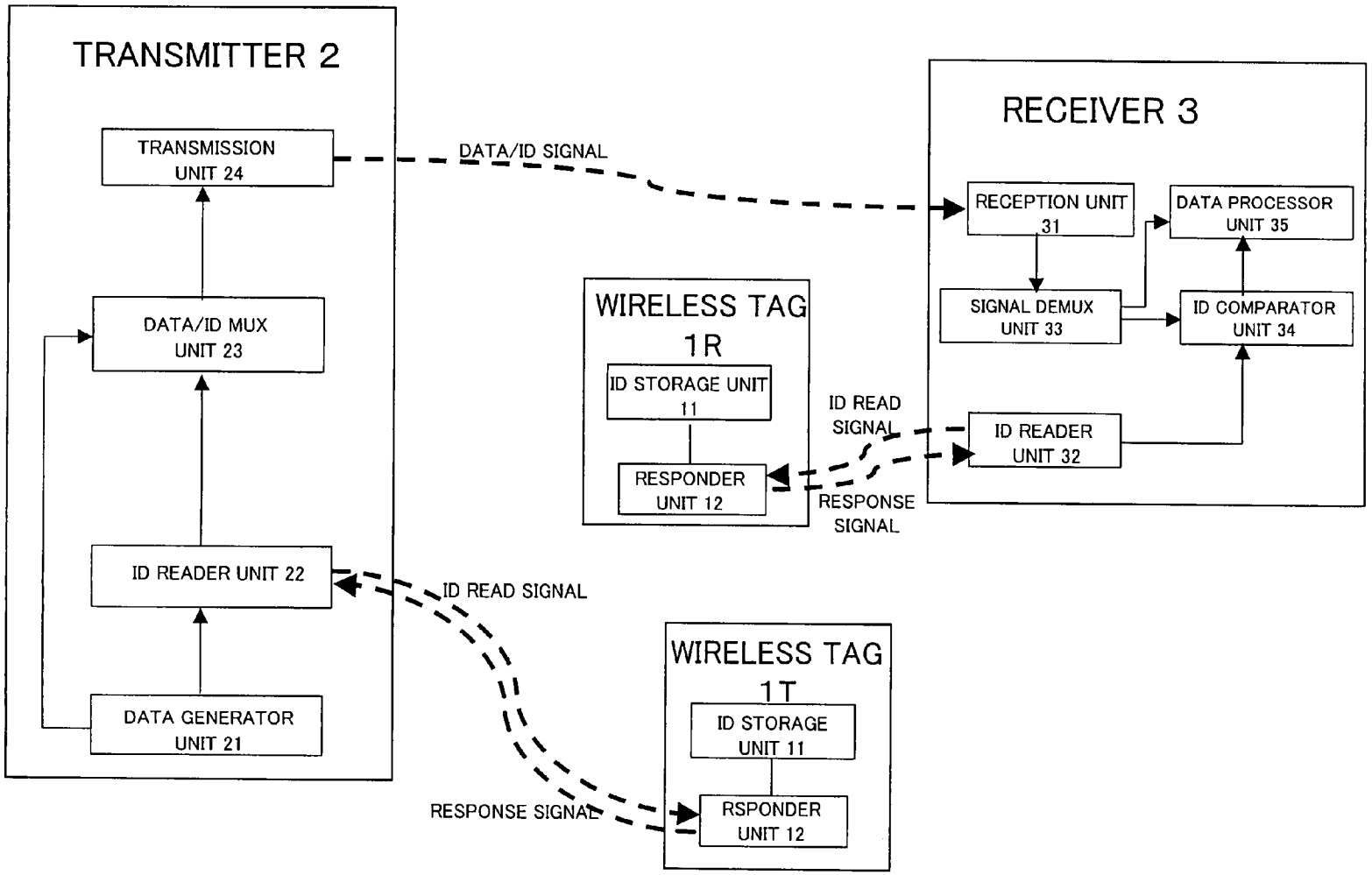
FIG. 1B is a block diagram showing the configurations of a transmitter, a receiver, and wireless tags in the communication system of the first embodiment.

FIGS. 1A and 1B illustrate a communication system according to a first embodiment of the present invention. In FIG. 1A, 1T and 1R denote wireless tags which are disposed at arbitrary locations such as on a ceiling, a wall, a floor, a desk and the like in buildings, and the numerals 2 and 3 denote a transmitter and a receiver. The wireless tags 1T and 1R store the same ID. The transmitter 2 transmits an ID read signal before transmitting data, and extracts an ID from a received response signal #1T returned from the wireless tag 1T in response to the ID read signal, multiplexes the read ID on the data to be transmitted, and transmits the data multiplexed with the ID. The receiver 3 in turn transmits an ID read signal upon receipt of a signal, extracts an ID from the signal, extracts an ID from a response signal #1R returned from the wireless tag 1R in response to the ID read signal, and compares the ID in the received signal with the ID read from the wireless tag 1R. In a case that the both IDs match, the receiver 3 determines that the received signal is destined for the receiver 3, and processes the data in the received signal.

In FIG. 1A, each of apparatus location areas St, SR serves as a transmitter location area when a transmitter is located therein, and serves as a receiver location area when a receiver is located therein. In this way, each of the apparatus location areas can be a transmitter location area or a receiver location area, but for convenience of description, one apparatus location area is called the "transmitter location area ST", while the other apparatus location area is called the "receiver location area SR" in the following description.

The transmitter location area ST is a zone where the transmitter 2 and the wireless tag IT therein can transmit/receive an ID read signal and a response signal in response to the ID read signal. The receiver location area SR is a zone where the receiver 3 and the wireless tag 1R therein can transmit/receive an ID read signal and a response signal in response to the ID read signal.

The ID read signal and response signal may be transmitted as radio-waves, infrared rays, ultrasonic waves, and the like, and have an intensity that is significantly lower than a communication signal sent from the transmitter 2 to the receiver 3 and thus have a short range. As will be appreciated from the foregoing, the transmitter location area ST and receiver location area SR are relatively small.

Thus, the transmitter 2 and receiver 3 are respectively located near to the wireless tags 1T and 1R which store the same ID and read the ID, so that communication can be conducted between the transmitter 2 and receiver 3. Also, since the wireless tags 1T and 1R store the same ID, the receiver 3 may be located near the wireless tag 1T, and the transmitter 2 may be located near the wireless tag 1R. Further, apparatuses having transmission and reception functions can make bidirectional communications therebetween.

The transmitter 2 and receiver 3 may be fixedly or semi-fixedly disposed near the wireless tags 1T and 1R, respectively, and at least one of the transmitter 2 and receiver 3 may be of a portable type. Any transmitter and receiver having a capability of reading an ID from a wireless tag can be available in the system.

In the first embodiment, as illustrated in FIG. 1B, the transmitter 2 comprises a data generator unit 21 for generating data to be transmitted, an ID reader unit 22 for reading the ID from the wireless tag 1T, a data/ID multiplexer (mux) unit 23 for combining or multiplexing the read ID on generated data, and a transmission unit 24 for transmitting the combined data and ID as a transmission signal.

The receiver in turn comprises a reception unit 31 for receiving a signal transmitted from the transmitter 2, an ID reader unit 32 for reading the ID from the wireless tag 1R, a signal demultiplexer (demux) unit 33 for separating the ID and data in the received signal, an ID comparator unit 34 for comparing the separated ID with the ID read by the ID reader unit 32 to determine whether or not the two IDs are the same, and a data processing unit 35 for processing the separated data.

Each of the wireless tags 1T and 1R, which are identical in configuration, comprises an ID storage unit 11 for storing the ID and a responder unit 12. The responder unit 12 reads the ID from the ID storage unit 11 in response to an ID read signal from the ID reader unit 22 (or the ID reader unit 32) of the transmitter 2 (or the receiver 3), and returns the ID as a response signal #1T (or #1R) to the ID reader unit.

Preferably, the ID is automatically read from the wireless tag 1T or 1R when the data generator unit 21 is driven in the transmitter 2 or when a signal is received in the receiver 3. Alternatively, the operator may operate the transmitter 2 or receiver 3 to cause the ID reader unit 22 or 32 to read the ID at a time, for example, when the transmitter 2 and receiver 3 are disposed near the associated wireless tags 1T and 1R, respectively. Further alternatively, the ID reader units 22, 32 may be automatically operated when the transmitter 2 and receiver 3 are powered, so that the transmitter 2 and receiver 3 read the ID from the wireless tags 1T and 1R, respectively. A time at which the ID reader unit 22 is operated may be determined in a similar manner in the second to fifth embodiments, later described.

Figure 2:
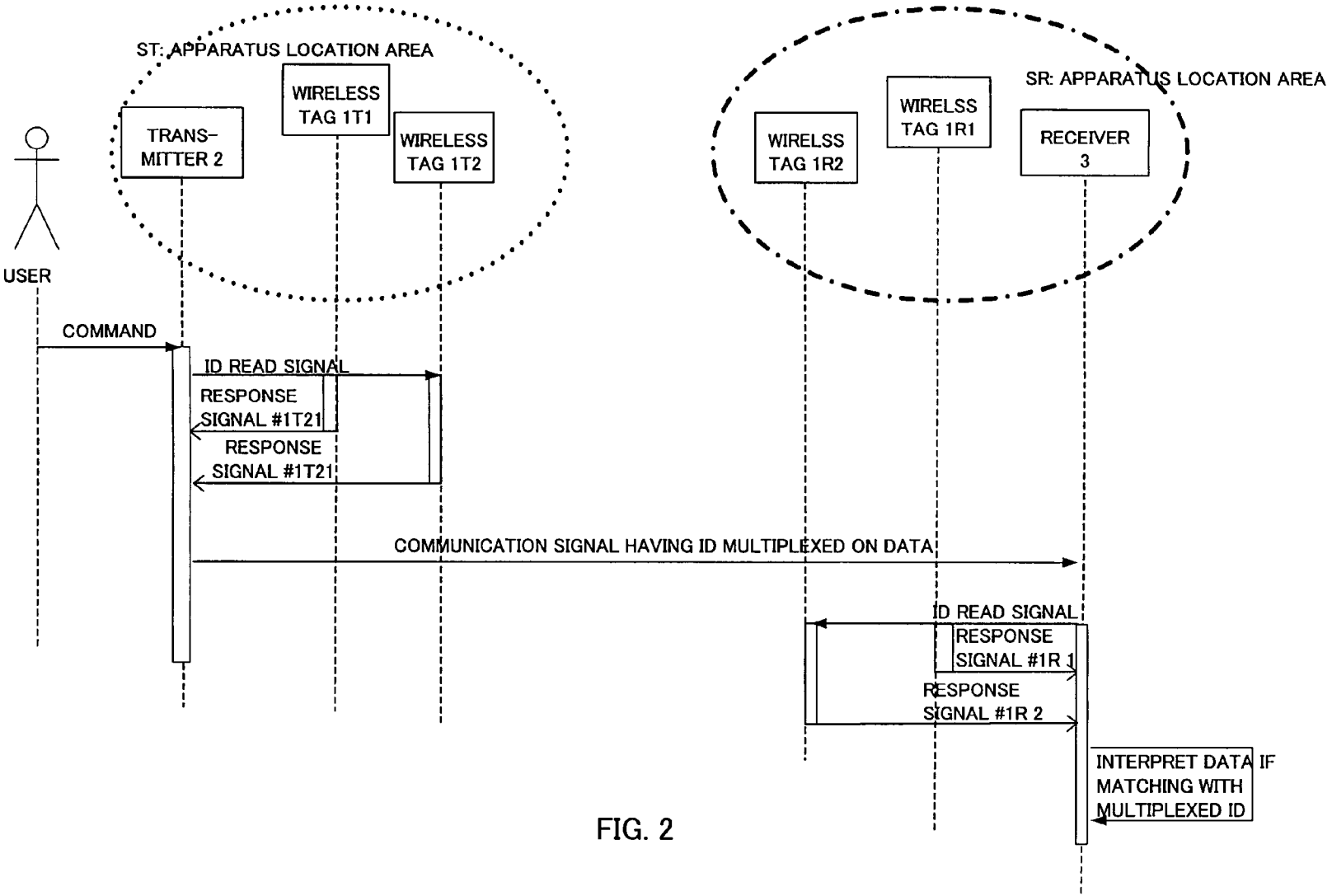
FIG. 2 is a block diagram for illustrating a communication system according to a second embodiment of the present invention.

FIG. 2 illustrates a communication system according to a second embodiment of the present invention. In the second embodiment, a plurality of wireless tags which store the same ID or different IDs, are dispersed within a transmitter location area ST, and a plurality of wireless tags which store the same ID or different IDs corresponding to the ID or IDs of the wireless tags in the transmitter location area ST, are dispersed within a receiver location area SR. In the example illustrated in FIG. 2, though not limited to this example, two wireless tags are located in each of the transmitter and receiver location areas ST and SR. A transmitter 2 and receiver 3 are substantially identical in configuration to the corresponding ones illustrated in FIG. 1B.

When the wireless tags in each area store the same ID, locations at which the transmitter 2 and receiver 3 are located, can be selected with some degree of freedom. In this event, a plurality of wireless tags may be placed in only one of the transmitter location area ST and receiver location area SR, and a single wireless tag may be placed in the other area. For example, when the receiver 3 is fixedly installed in the receiver location area SR, a single wireless tag may be placed in the area SR, while a plurality of wireless tags having the same ID may be placed in the transmitter location area ST.

When a plurality of wireless tags have different IDs in each area, the ID comparator unit 34 of the receiver 3 can be configured to determine that a received signal is addressed to the receiver 3 when all the different IDs read by the receiver 3 match with the different IDs included in the received signal. Alternately, the unit 34 of the receiver 3 can be configured to determine that the signal is addressed to the receiver 3 when even one of the read different IDs matches with any of the IDs included in the received signal. In the former case, the degree of freedom in selecting locations at which the transmitter 2 and receiver 3 are installed is reduced.

In the first and second embodiments, one of the transmitter 2 and receiver 3 may store an ID(s), instead of being located in the area ST or SR. In this case, the ID may be stored in a memory card or the like and the memory card is loaded into the transmitter 2 or receiver 3 when a communication is conducted.

Figure 3A:
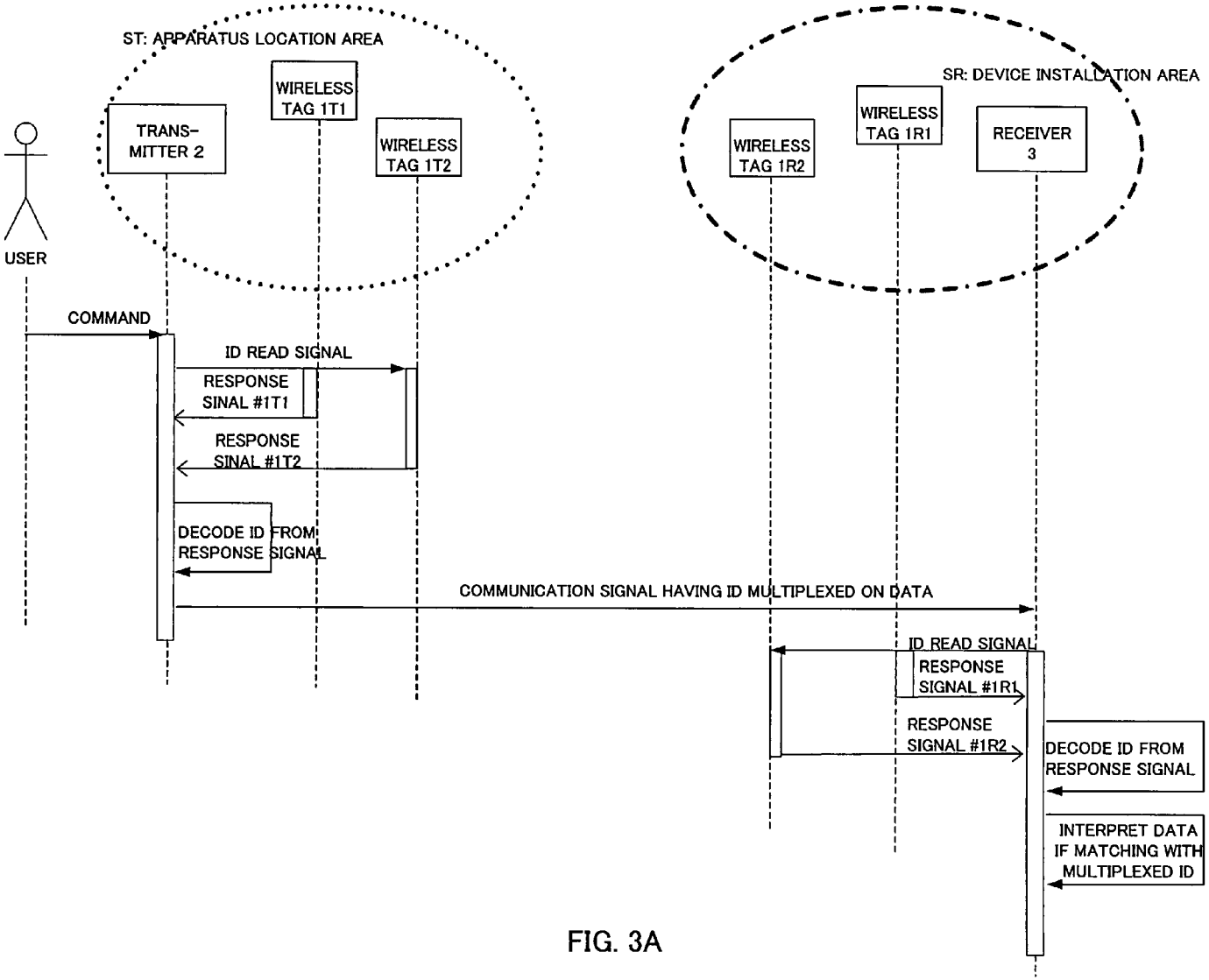
FIG. 3A is a block diagram for illustrating a communication system according to a third embodiment of the present invention.
Figure 3B:
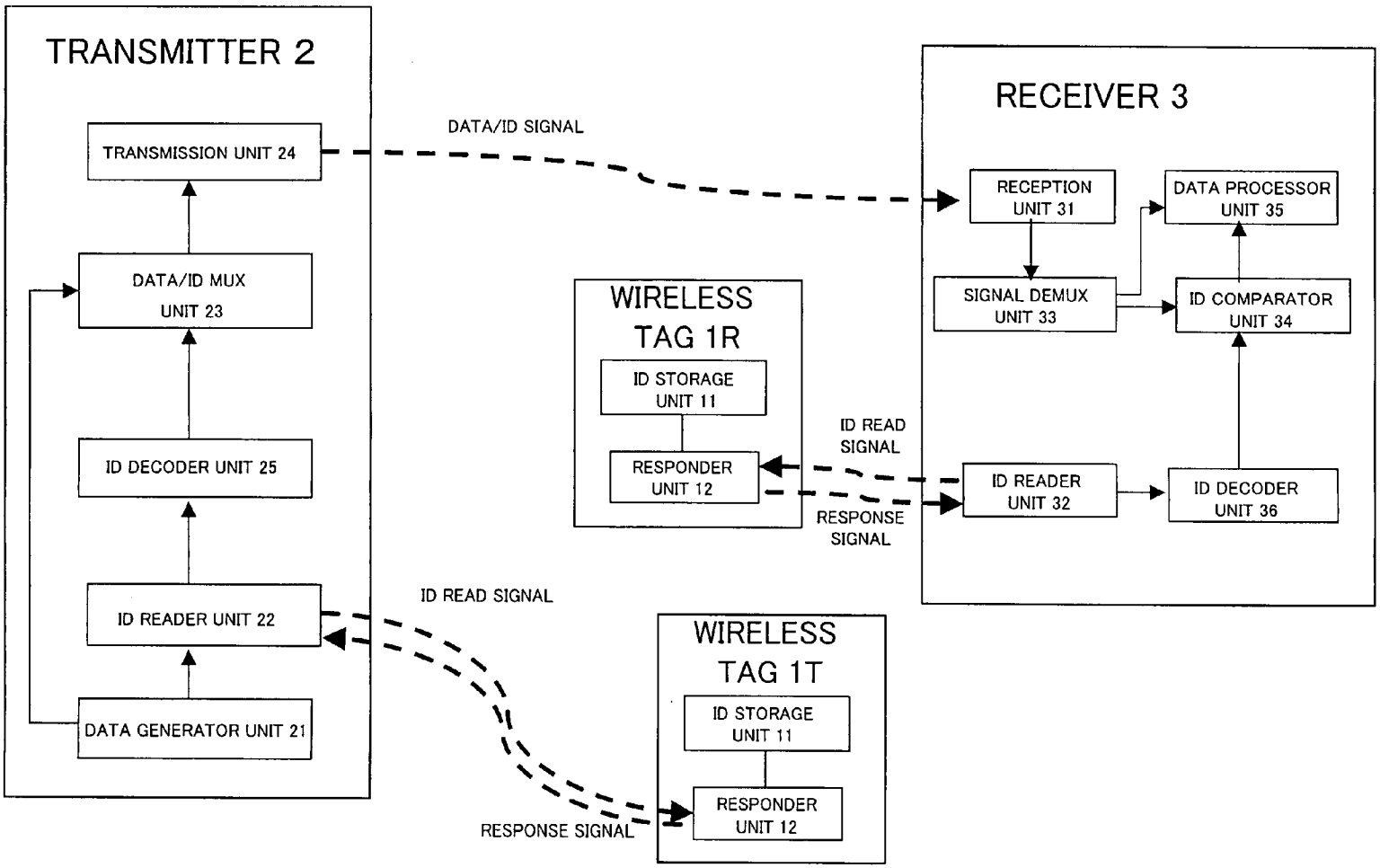
FIG. 3B is a block diagram showing the configurations of a transmitter, a receiver, and wireless tags in the communication system of the third embodiment.

FIGS. 3A and 3B illustrate a communication system according to a third embodiment of the present invention. In the third embodiment, a plurality of wireless tags are provided in both of a transmitter location area ST and receiver location area SR, and the FEC (forward error correction) coding is applied to the assignment of ID to the wireless tags, and each of a transmitter 2 and receiver 3 comprises an ID decoding means. The FEC coding involves dividing original data into $\underline{k}$ blocks, and encoding by redundantly allocating the $\underline{k}$ blocks to $\underline{n}$ blocks, where $\underline{n}$ is larger than $\underline{k}$, such that the original data can be reproduced from $\underline{k}$ blocks of the encoded $\underline{n}$ blocks.

In the third embodiment which applies the FEC coding, for example, as illustrated in FIG. 3A, two wireless tags 1T1 and 1T2 are provided in the transmitter location area ST, and two wireless tags 1R1 and 1R2 are provided in the receiver location area SR. The number of wireless tags is not limited to the foregoing, but a plural number of wireless tags may be located in each area. In the third embodiment, one ID, which is relatively long, is divided into three (=k) blocks, and these three blocks are redundantly assigned to four blocks (=n) to create four segments which are assigned to and stored in the wireless tags 1T1, 1T2, 1R1, and 1R2, respectively.

Each of the wireless tags also includes such information as the number of redundantly divided segments (n) and segment index number (0, 1, . . . , n−1) in addition to the encoded value of the divided segment. The segment index number correspond to row numbers of a generation matrix which is required for FEC encoding and decoding operations.

As illustrated in FIG. 3B, the transmitter 2 comprises an ID decoder unit 25 which decodes ID information within response signals retuned from the wireless tags 1T1 and 1T2, in reply to a reading operation by the ID reader unit 22, to restore or reproduce the original ID. The receiver 3 also comprises an ID decoder unit 36 which has similar functions as that of the unit 25.

For example, when an ID segment stored in a wireless tag includes two divided sections, ID information of the segment is represented by:

Number of Divisions+Number of Redundant Divisions

+ (Segment Index Number+Encoded Value of Divided Section)

+ (Segment Index Number+Encoded Value of Divided Section)

Based on the foregoing ID information, the ID decoder units 25 and 36 decode the original ID and supply them to the data/ID multiplexer unit 23 and ID comparator unit 34, respectively.

Generally, a wireless tag can store a limited length of ID (the number of bytes of an encoded value(s)), so that when a long ID is necessary, it is necessary that it be divided. However, if one ID is simply divided into k sections which are assigned to and stored in k wireless tags, all the k wireless tags must be provided in each area (the transmitter location area or receiver location area) in order to restore the original ID. Further, when read errors of the wireless tags are taken into consideration, k wireless tags are not sufficient, and a number of wireless tags approximately twice as the value of k must be provided in the area. On the contrary, when the FEC coding is applied as in the third embodiment of the present invention, a much smaller number of wireless tags are required proportional to expected read errors, as compared with the simple division of the ID.

In addition, when all wireless tags placed near the transmitter and receiver have different IDs, it is necessary to store a list of the IDs of these wireless tags for management by a positional information server or the like, in order to identify where the transmitter and receiver are situated. For this reason, even when the ID is simply divided to assign the divided sections to wireless tags, a positional information server or the like must manage a list of ID segments stored in the respective wireless tags. In the third embodiment of the present invention, though ID segments stored in the respective wireless tags have different values, they can be decoded into the same ID, so that it is not necessary to manage the positions of the wireless tags.

Figure 4A:
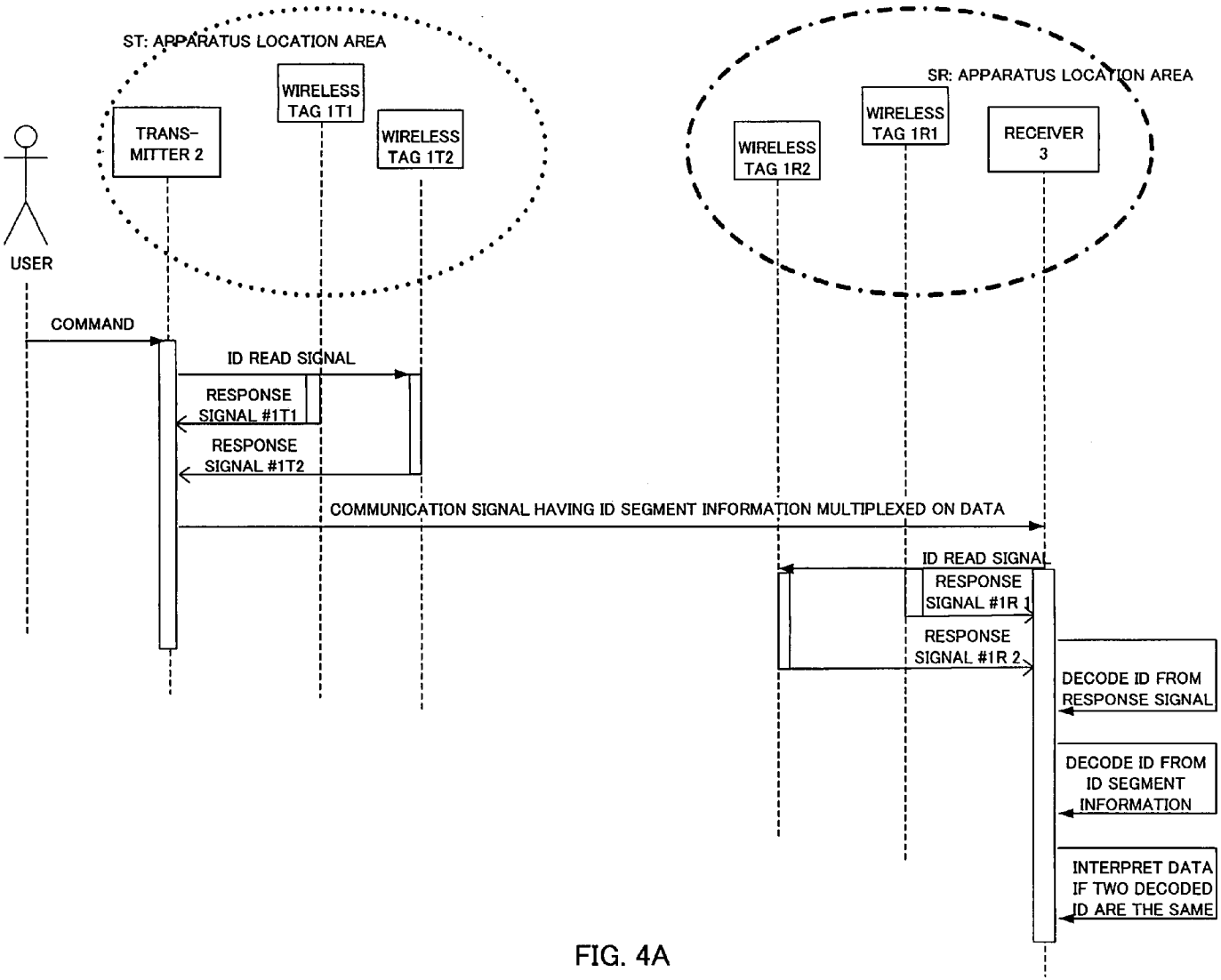
FIG. 4A is a block diagram for illustrating a communication system according to a fourth embodiment of the present invention.
Figure 4B:
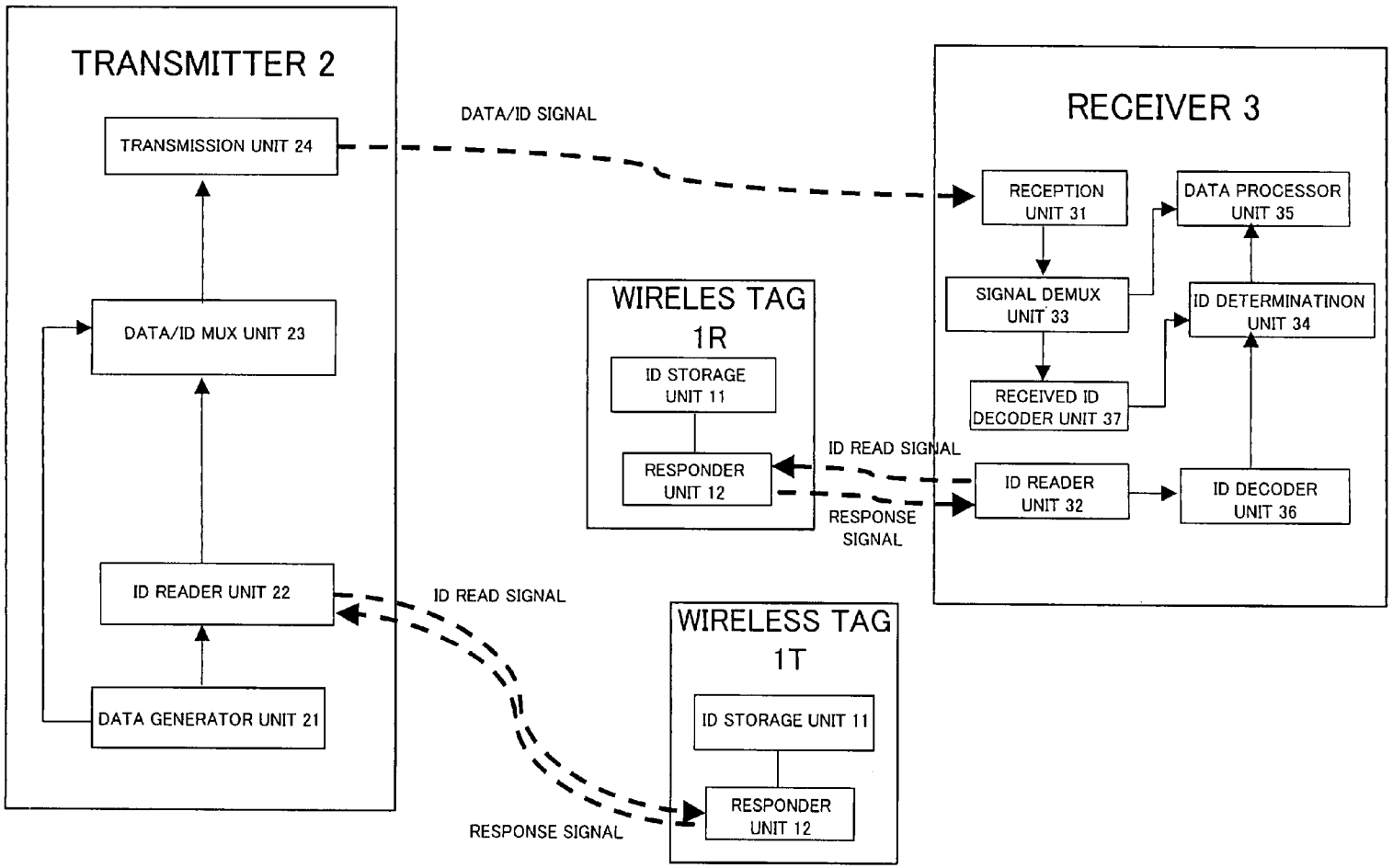
FIG. 4B is a block diagram showing the configurations of a transmitter, a receiver, and wireless tags in the communication system of the fourth embodiment.

FIGS. 4A and 4B illustrate a communication system according to a fourth embodiment of the present invention. In the fourth embodiment, a plurality of wireless tags (for example, two) are provided in each of a transmitter location area ST and receiver location area SR, and the FEC coding technique is applied to the assignment of ID segments to these wireless tags, as in the third embodiment. However, as illustrated in FIG. 4B, a transmitter 2 does not comprise the ID decoder unit 25 (see FIG. 3B), and the transmitter 2 multiplexes two ID segments read from the wireless tags 1T1 and 1T2, as they are, on a data signal to be transmitted, and transmits the resultant transmission signal. Then, a receiver 3 decodes the ID segments extracted from a received signal into the original ID, and compares the decoded ID with an ID restored by decoding ID segments which are read from the wireless tags 1R1 and 1R2. The decoding of the ID segments extracted from the received signal in the receiver 3 is performed in a received ID decoder unit 37.

Figure 5:
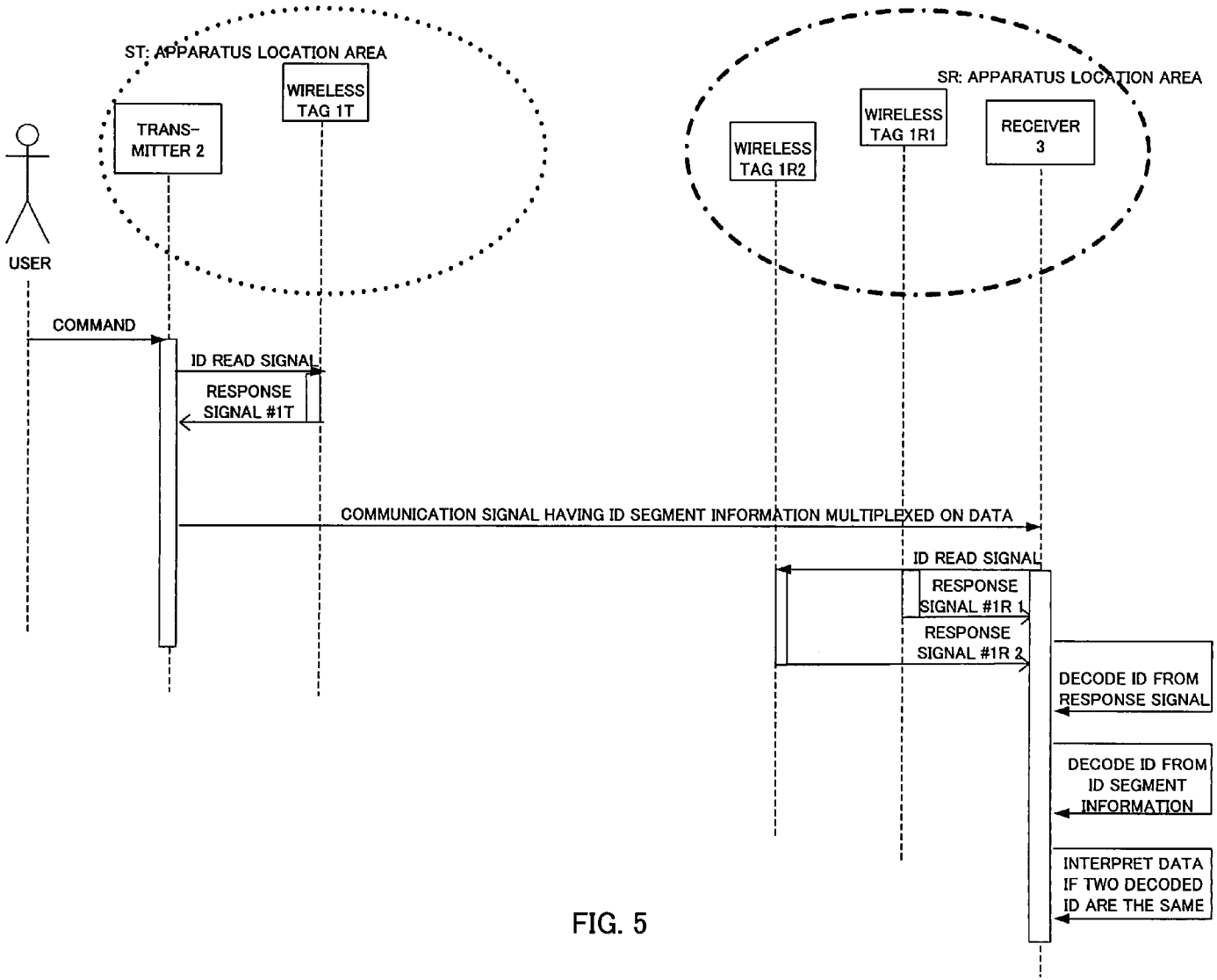
FIG. 5 is a block diagram for illustrating a communication system according to a fifth embodiment of the present invention.

FIG. 5 illustrates a communication system according to a fifth embodiment of the present invention. In the fifth embodiment, a transmitter 2 and receiver 3 are substantially identical in configuration to the corresponding ones of the fourth embodiment illustrated in FIG. 4B. The fifth embodiment is identical to the fourth embodiment in that a plurality of wireless tags store ID segments instead of original IDs, whereas the fifth embodiment differs in that there is only one wireless tag (wireless tag 1T) which is provided in a transmitter location area ST. Therefore, a signal transmitted from the transmitter 2 carries information of only one ID segment, i.e., only part of the information required to restore the original ID. Then, the receiver 3 uses the ID segment included in a received signal and ID segments read from the wireless tags 1R1, 1R2 near the receiver 3, to decode the original ID. This decoding is performed by the received ID decoder unit 37 as shown in FIG. 4B.

In the third to fifth embodiments which apply the FEC coding technique, the communication system may utilize an algorithm which weights a specific redundantly divided position, for example, redundantly divided position 0, and disables the decoding if a divided section at redundantly divided position 0 is not obtained in the ID decoder units 25 and 36 (and 37). Alternatively, an ID segment including a weighted divided section may not be stored in a wireless tag which is located at a fixed position, but may be stored in a portable apparatus such as a portable telephone, a watch, or the like. By this system, no communication can be established unless a person who owns the portable apparatus is present in the transmitter location area ST or receiver location area SR. This is extremely practical when parental control and/or domestic privacy is required on the communication system.

Also, in the third to fifth embodiments, one of a plurality of ID segments may be previously stored in the transmitter 2 or receiver 3. Alternatively, one ID segment may be stored in a removable memory card, such that the communication system may be operable when the transmitter 2 or receiver 3 is loaded with the memory card. Further, a responder or wireless tag may be electrically connected to a communication apparatus such as a personal computer connected to a network, so that the ID segment may be retrieved from a storage apparatus or a processing apparatus on the network through the communication apparatus, and return the ID segment in response to a read signal from the transmitter 2 or receiver 3. In addition, in the third embodiment, the original ID may be stored in one of the transmitter 2 and receiver 3. In this case, the apparatus (or the transmitter or receiver) which stores the original ID does not require to comprise an ID decoder unit, and do not need to reside in the apparatus location area.

Similarly, in the first and second embodiments, it may be possible that only one of the transmitter 2 and receiver 3 stores the ID, while the other has the ID reading function (from the tag). Alternatively, a responder or wireless tag may be connected to a communication apparatus such as a personal computer connected to a network, so that the ID may be retrieved from a storage apparatus or a processing apparatus on the network through the communication apparatus, and returns the ID in response to a read signal of the transmitter 3 or receiver 2.

In the first to fifth embodiments described above, the communication system has the transmitter location area ST spaced apart from the receiver location area SR. However, these two areas may partially overlap or wholly match with each other. For example, when the transmitter location area ST substantially wholly matches with the receiver location area SR, the transmitter 2 and receiver 3 can read the ID from the same wireless tag, so that all the wireless tags may have different IDs.

Also, in the foregoing embodiments, the wireless tag is constituted to be a passive device which returns the information of the ID or ID segment, in response to the ID read signal. Alternatively, the wireless tag may be constituted to be an active wireless tag which actively outputs ID information at predetermined intervals even without receiving the ID read signal.

Further, when a plurality of wireless tags are provided in each of the apparatus location areas, a combination of active wireless tags and passive wireless tags may be used.

Also, while the foregoing embodiments have been described for a case in which there are the transmitter 2 and receiver 3 which communicate in a one-to-one relationship, they may be in a one-to-multiple, a multiple-to-one, or a multiple-to-multiple relationship. For example, a plurality of receiver location areas SR may be provided to correspond to a single transmitter location area ST, or a single receiver location area SR may be provided to correspond to a plurality of transmitter location areas ST.

In the first to fifth embodiments described above, when a plurality of receiver location areas SR overlap with one another, i.e., when a plurality of apparatus location areas overlap with one another, and a single receiver 3 is located in the overlapping region, wireless tags provided in the respective apparatus location areas may store different IDs (or an original ID composed of ID segments), so that the receiver 3 can receive only communication signals from the respective transmitter location area(s) ST corresponding thereto. This applies to a plurality of transmitter location areas ST which overlap with one another.

In the third to fifth embodiments which apply the FEC coding, when a plurality of receiver location areas overlap with one another, the receiver 3 will receive ID segments from all of these areas, so that the receiver 3 may not successfully decode an original ID. This problem can be solved by determining the values of identifiers such that an area has a different identifier to that of any adjacent area, adding the identifiers corresponding to the overlapping apparatus location areas, to the ID segments, respectively, and storing the resultant ID segments in the wireless tags. Since the receiver 3 can perform the decoding of the ID segments for each identifier, the receiver 3 can restore the original IDs in all these areas.

In the first to fifth embodiments, Instant Messaging can be utilized for communicating between the transmitter 2 and receiver 3. For example, assuming that apparatuses which make communications are personal computers capable of transmission and reception, and these personal computers reside in apparatus location areas in which a wireless tag(s) or an active wireless tag(s) is provided, personal computers in those apparatus location areas which have the same ID, can be grouped to form a chat group or the like. IP multicast may also be utilized as a communication means.

At present, wireless technologies are often used to transmit signals even in a relatively small range, such as within a room. In this event, if similar wireless systems are used in two adjacent conference rooms which are not equipped with an electromagnetic shielding function, wireless signals in one conference room may reach the other conference room, possibly interfering with a receiver or the like in the other conference room. A similar problem may arise in a private residence or the like.

To solve the foregoing problem, conventionally, an electromagnetic shield is provided to prevent electromagnetic waves from reaching the other conference room, or communication apparatuses are brought closer to each other manually.

However, the provision of a shielding facility in a conference room or the like will entail a relatively high financial investment, and a shielding facility cannot be provided in some sites. On the other hand, the requirement of bringing apparatuses for communication close to each other manually, cannot be said to be convenient for the operator.

Figure 6A:
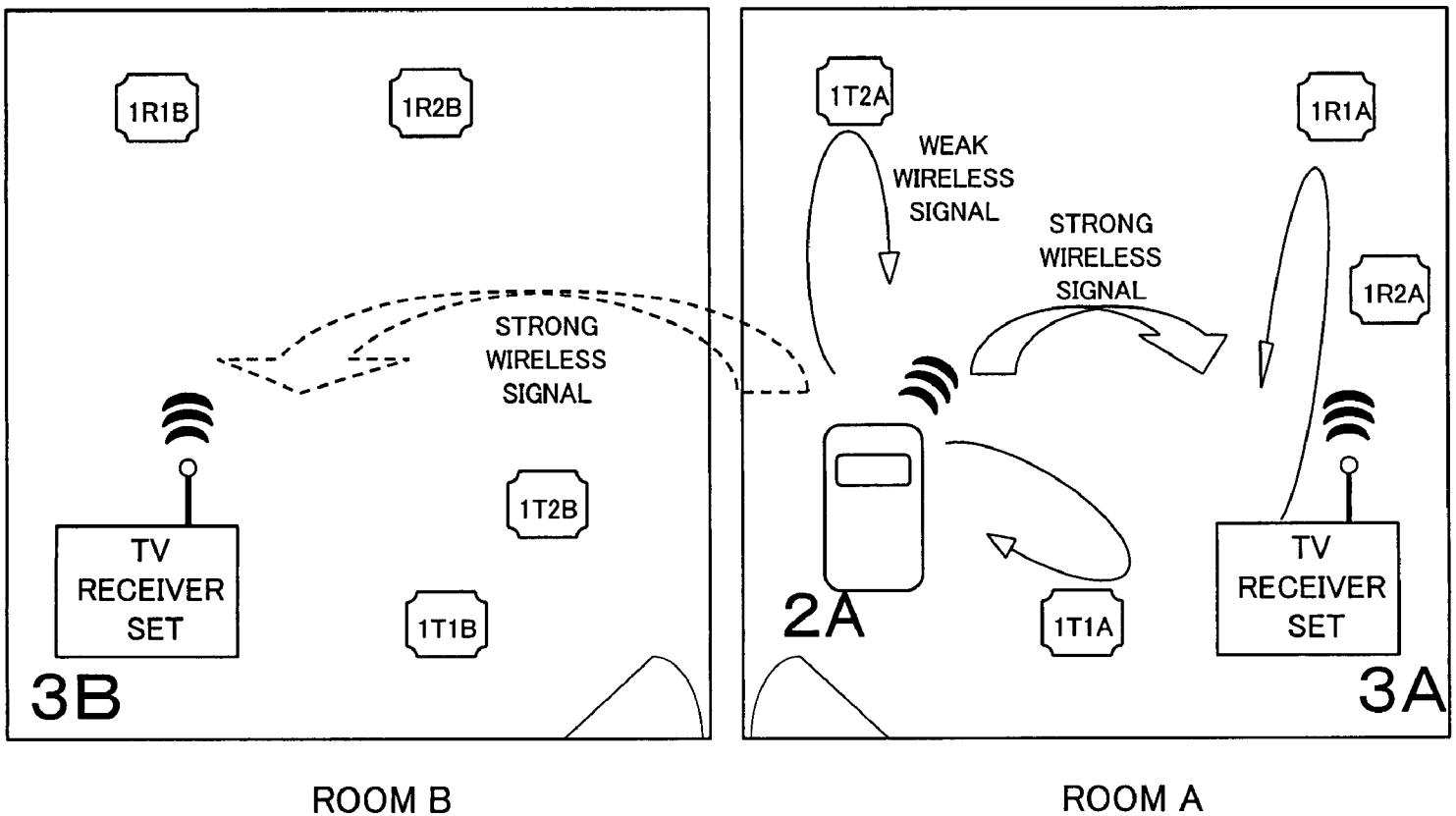
FIG. 6A is a block diagram illustrating a communication system according to the present invention when it is applied to a TV remote control system for remotely controlling a TV receiver set.
Figure 6B:
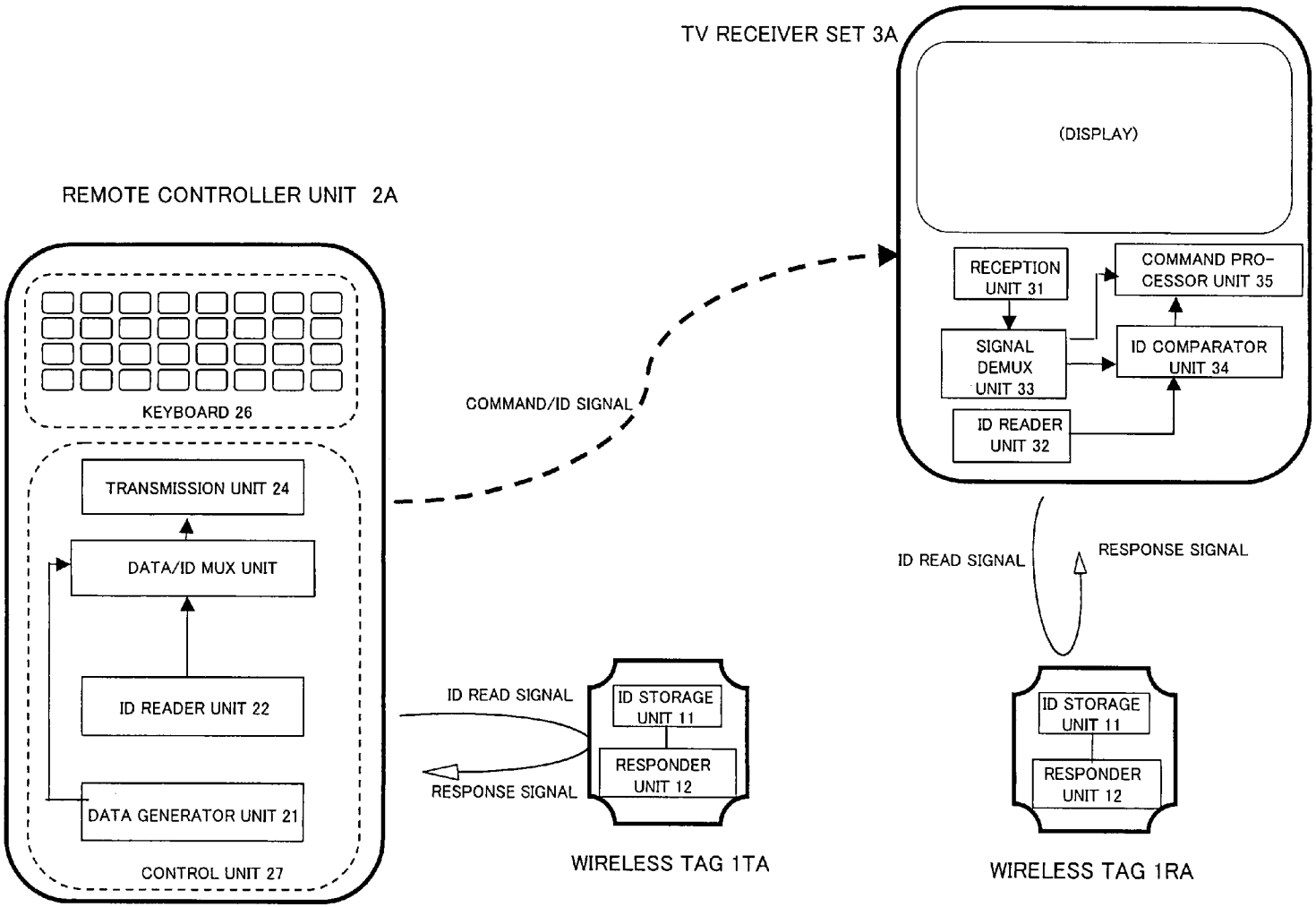
FIG. 6B is a block diagram showing the configurations of a remote control unit, a TV receiver set, and wireless tags in the TV remote control system shown in FIG. 6A.

According to the present invention, the foregoing problems can be solved as described below. FIGS. 6A and 6B illustrate an exemplary solution in which the second embodiment of the present invention is applied to a remote control system for a television receiver set. It should be noted, however, that a transmitter location area matches with a receiver location area in this remote control system.

In FIGS. 6A and 6B, TV receiver sets 3A, 3B are placed in adjacent rooms A and B, respectively, and a remote control unit 2A can be used commonly for the TV receiver sets 3A and 3B. Wireless tags 1T1A, 1T2A, 1R1A, and 1R2A are fixed at locations such as on a wall surface, a ceiling, a floor, or the like of the room A, while wireless tags 1T1B, 1T2B, 1R1B, and 1R2B are fixed in a similar manner. While FIG. 6A illustrates an example in which four wireless tags are installed in each room, the number of the wireless tags is not limited to four, but an arbitrary number of wireless tags may be installed in each room. In each room, when a transmitter location area ST completely matches with a receiver location area SR, all the wireless tags may store different IDs from one another.

Assuming that the TV remote control system does not employ wireless tags as in a conventional system, even if the remote control unit 2A is manipulated to control the TV receiver 3A in the room A, a wireless TV command signal from the remote control unit 2A can reach the TV receiver set 3B in the room B, because of a relatively large field strength of the command signal. This can undesirably control the TV receiver set 3B as well. The present invention can eliminate such a malfunction by the location of wireless tags in each room.

As illustrated in FIG. 6B, the remote control unit 2A comprises a command generator unit 21 for generating a command signal for controlling a receiving condition of a TV signal at the TV receiver unit 3A or 3B, an ID reader unit 22 for transmitting an ID read signal and receiving an ID returned from a wireless tag which has received the ID read signal, a command/ID multiplexer unit 23 for combining one or a plurality of obtained IDs to the command signal from the command generator unit 21 to generate a command/ID signal, and a transmission unit 24 for transmitting the generated command/ID signal.

The remote control unit 2A further comprises a keyboard 26 for driving the command generator unit 21 and ID reader unit 22 to generate a command signal and an ID read signal, and a control unit 27 for generally controlling the remote control unit 2A.

When the ID read signal transmitted from the ID reader unit 22 is carried by a radiowave, its intensity is set to be smaller than the command/ID signal, so that the read signal reaches the wireless tags in the room A but not the wireless tags in the adjacent room B when the ID read signal is generated from the remote control unit 2A in the room A. In addition, when the response signals from the wireless tags are radiowave signals, their intensities must be so small as to be unable to reach the adjacent room B. Preferably, a high frequency signal is utilized because such a signal is characterized by largely attenuating when it passes through a wall.

The ID read signal from the remote control unit 2A and the response signal returned from the wireless tag may be infrared signals or ultrasonic signals.

The ID stored in the wireless tag can be read, for example, by manipulating the remote control unit 2A before a conference begins, such that the read ID can be pre-stored. Subsequently, when the keyboard 26 of the remote control unit 2A is operated to generate a command signal from the command generator unit 21, the command/ID multiplexer unit 23 combines the command signal with the pre-stored ID, and the transmission unit 24 transmits the combined command/ID signal.

Alternatively, when the keyboard 26 of the remote control unit 2A is operated to generate a command signal, the ID reader unit 22 may automatically read the ID, and the command/ID multiplexer 23 may combine the command signal with the ID.

As illustrated in FIG. 6B, the TV receiver set 3A comprises a reception unit 31 for receiving the command/ID signal from the remote control unit 2A, an ID reader unit 32 for transmitting an ID read signal and receiving an ID returned from a wireless tag, a signal demultiplexer unit 33 for separating the received command/ID signal into a command signal and ID, an ID comparator unit 34 for comparing the separated ID with the ID obtained by the ID reader unit 32 to determine whether or not the two IDs are the same, and a command processing unit 35 for processing the separated command signal to control the TV signal reception at the TV receiver set 3A.

The ID read signal from the TV receiver set is also set to have low power such that the read signal does not reach the adjacent room, as is the case with the remote control unit. Therefore, IDs can be read only from the wireless tags in the room A in which the TV receiver set 3A is installed. A high frequency signal is preferably utilized for the ID read signal from the TV receiver because the high frequency signal is characterized by largely attenuating when it passes through a wall. The ID read signal may be an infrared signal or an ultrasonic signal.

In the TV receiver set 3A, the ID comparator unit 34 compares the ID separated by the signal demultiplexer unit 33 with the ID obtained by the ID reader unit 32, and determines that the command signal from the remote control unit 2A is addressed thereto when the two IDs are the same. Then, the command processing unit 35 controls the operation of the TV receiver set 3A based on the command signal which has been determined to be a command signal addressed thereto.

The TV receiver set 3B is also similar in configuration to the TV receiver set 3A.

As will be apparent from the foregoing description, in the TV remote control system illustrated in FIGS. 6A and 6B, the remote control unit 2A reads out one or a plurality of IDs stored in the wireless tags 1T1, 1T2, 1R1, and 1R2 provided in the room A, and transmits the ID (IDs) and a command signal to the TV receiver set 3A, for controlling the operation of the TV receiver set 3A. The TV receiver set 3A determines whether or not the ID (IDs) read out from the wireless tag(s) matches with the ID (IDs) multiplexed on the received signal. In this way, the TV receiver set 3A can recognize a command signal from the remote control unit 2A which resides in the room A, and is controlled to receive a television program in response to the command signal.

On the other hand, the TV receiver set 3B in the adjacent room B, even if a command signal reaches from the remote control unit 2A, can recognize that ID (IDs) sent thereto together with the command signal, is not from the room B. Consequently, the TV receiver set 3B will not undesirably operate in response to a command signal from the room A.

In the TV remote control system illustrated in FIGS. 6A and 6B, when the wireless tags 1T1, 1T2, 1R1, and 1R2 store different IDs from one another, a problem arises when the room A is relatively large. For example, when the remote control unit 2A can read IDs only from the wireless tags 1T1 and 1T2, and the TV receiver set 3A can read IDs only from the wireless tags 1R1 and 1R2, the IDs read out by the remote control unit 2A are different from the IDs read out by the TV receiver set 3A, causing the ID comparator unit 34 of the TV receiver set 3A to determine that a command signal from the remote control unit 2A is not addressed to the TV receiver set 3A. Consequently, the TV receiver set 3A, even when receiving a command signal addressed thereto, will not respond to the command signal.

The foregoing problem can be solved by dividing and encoding an ID into a plurality of ID segments using the FEC coding, and assigning these ID segments to the respective wireless tags, as in the third to fifth embodiments.

While the foregoing embodiment has been described in connection with the transmission of a command signal from the remote control unit to TV receiver sets, it should be understood that the present invention can be applied to any target apparatus other than the TV receiver set as long as the apparatus is controlled by a remote control unit for its operation. Also, while the foregoing embodiment has been described for an example in which there are a control apparatus and a target apparatus which communicate in a one-to-one relationship, they may be in a one-to-multiple, a multiple-to-one, or multiple-to-multiple relationship. Further, the wireless tags may be of an active type.

The communication system of the present invention can also be applied to a communication system in which a plurality of communication apparatuses transmit and receive data in one conference room. Specifically, in a case that a certain communication apparatus implemented by a personal computer sends data to a second certain communication apparatus(s) implemented by a personal computer(s) within a conference room, wireless tags storing IDs have been provided in the room. Further, the first certain personal computer is provided with a function of reading out the ID from the wireless tag and a function of combining or multiplexing the ID to data and transmitting the resultant data, and the second personal computer is provided with a function of reading out the ID of the wireless tag, a function of extracting the ID from the received data, and a function of determining whether the ID read from the tag is the same as the extracted ID. All the computers in the conference room may be provided with the function of reading out the ID from the wireless tag, the function of combining the ID with data and transmitting the resultant data, the function of extracting the ID from the received data, and the function of determining whether or not the read ID is the same as the extracted ID.

In this way, even when similar communication apparatuses are located in an adjacent room, data created from a given conference room will not be undesirably received by personal computers in the adjacent room, and data from an originating personal computer can be displayed only on the personal computers in the same conference room.

According to the present invention configured as described above, in an environment in which a plurality of receivers reside and can receive a signal transmitted by a transmitter, or in an environment in which a plurality of transmitters reside each for transmitting a signal which can be received by a receiver, no ID need be fixedly stored in the transmitters or receivers beforehand. Further, when a transmitter and receiver are located in previously set apparatus location areas corresponding to each other, the transmitter and receiver can obtain an ID stored in a wireless tag (or an active wireless tag) and multiplex the ID on a transmission signal. Thus, the present invention is highly practical when changes are frequently made in a combination of a transmitter with a receiver, between which communications should be made.

When an ID is divided into a plurality of ID segments which are redundantly assigned and stored in wireless tags (or active wireless tags), respectively, utilizing the FEC (Forward Error Correction) coding technique, the wireless tags (or active wireless tags) can have a smaller storage capacity, and a shorter time can be required to read out the ID. Also, while the respective wireless tags (or active wireless tags) store ID segments having different code values, the same original ID can be restored by decoding, so that it is not necessary to manage the positions of the individual wireless tags (or active wireless tags). Specifically, when all wireless tags (or active wireless tags) near a transmitter or a receiver store different IDs from one another, a list of the IDs stored in these wireless tags (or active wireless tags) must be stored in and managed by a positional information server or the like, in order to identify the positions at which the transmitter and receiver are located. The present invention, however, can eliminate such requirements.

While the present invention has been described in connection with several preferred embodiments thereof, it should be apparent to those skilled in the art that the present invention is not limited to the preferred embodiments described above, but can be modified in a variety of ways without departing from the spirit and scope of the invention as defined in the appended claims.

What is claimed is:

1. A communication system which allows only an intended receiver(s) to receive a communication signal from a transmitter(s) in an environment in which a plurality of receivers are capable of receiving a communication signal transmitted from the transmitter, the communication system comprising:

at least one first wireless tag for defining a first apparatus location area, the first wireless tag storing an ID;

at least one second wireless tag for defining a second apparatus location area, the second wireless tag storing an ID that is the same as the ID stored in the first wireless tag in the first apparatus location area;

a transmitter comprising reading means for outputting a wireless ID read signal to read out the ID of the first or second wireless tag when the transmitter resides in the first or second apparatus location area, respectively, and means for multiplexing the read ID on a communication signal and transmitting the communication signal; and a receiver comprising reading means for outputting a wireless ID read signal to read the ID of the second or first wireless tag when the receiver resides in the second or first apparatus location area, respectively, means for determining whether or not an ID identical to the read ID is multiplexed on a received communication signal, and means for determining that the communication signal is addressed to the receiver when it is determined that the ID identical to the read ID is multiplexed on the transmission signal, wherein a signal from the transmitter residing in one of the first and second apparatus location areas can be received by the receiver residing in the other apparatus location area.

2. A communication system according to claim 1, wherein:

the first apparatus location area is defined by a plurality of the first wireless tags, each of the first wireless tags storing a different ID from one another; and the second apparatus location area is defined by a plurality of the second wireless tags, each of the second wireless tags storing an ID that is the same as one of the IDs stored in the first wireless tags, respectively.

3. A communication system according to claim 2, wherein at least one of the first wireless tags is common to at least one of the second wireless tags, so that the first apparatus location area at least partially overlaps with the second apparatus location area.

4. A communication system according to claim 1, wherein the ID read signal output from the reading means of the respective transmitter and receiver is one of an infrared signal, an ultrasonic signal, and a radiowave signal, the signal having a low field intensity.

5. A communication system according to claim 1, wherein upon receipt of the ID read signal, the first and second wireless tags output their own IDs in the form of an infrared signal, an ultrasonic signal, or a radiowave signal, the signal having a low field intensity.

6. A communication system according to claim 1, wherein the transmitter and receiver are, respectively, a control apparatus and target apparatus to be controlled thereby.

7. A communication system according to claim 6, wherein the control apparatus and target apparatus are a remote control unit and TV receiver set, respectively.

8. A communication system according to claim 1, wherein the receiver and transmitter are personal computers.

9. A communication system according to claim 1, wherein the communication signal transmitted from the transmitter to the receiver is a wireless communication signal.

10. A communication system which allows only an intended receiver(s) to receive a communication signal from a transmitter(s) in an environment in which a plurality of receivers are capable of receiving a communication signal transmitted from the transmitter, the communication system comprising:

at least one first active wireless tag for defining a first apparatus location area, the first active wireless tag storing an ID and actively outputting the ID;

at least one second active wireless tag for defining a second apparatus location area, the second active wireless tag storing an ID that is the same as the ID stored in the first active wireless tag in the first apparatus location area, and actively outputting the ID;

a transmitter comprising reading means for collecting the ID output from the first or second active wireless tag when the transmitter resides in the first or second apparatus location area, respectively, and means for multiplexing the read ID on a communication signal and transmitting the communication signal; and a receiver comprising reading means for reading the IDs from the second or first wireless tag, means for determining whether or not an ID identical to the read ID is multiplexed on a received communication signal, and means for determining that the communication signal is addressed to the receiver when it is determined that the ID identical to the read ID is multiplexed on the received communication signal, wherein a signal from the transmitter residing in one of the first and second apparatus location areas can be received by the receiver residing in the other apparatus location area.

11. A communication system according to claim 10, wherein:

the first apparatus location area is defined by a plurality of the first active wireless tags, each of the first active wireless tags storing a different ID from one another;

the second apparatus location area is defined by a plurality of the second active wireless tags, each of the second active wireless tags storing an ID that is the same as the ID stored in one of the first active wireless tags, respectively.

12. A communication system according to claim 11, wherein at least one of the first active wireless tags is common to at least one of the second active wireless tags, so that the first apparatus location area at least partially overlaps with the second apparatus location area.

13. A communication system according to claim 10, wherein each of the first and second active wireless tags is configured to output its own ID in the form of an infrared signal, an ultrasonic signal, or a radiowave signal, the signal having a low field strength.

14. A communication system according to claim 10, wherein the transmitter and receiver are, respectively, a control apparatus and target apparatus to be controlled thereby.

15. A communication system according to claim 14, wherein the control apparatus and target apparatus are a remote control unit and TV receiver set, respectively.

16. A communication system according to claim 10, wherein the receiver and transmitter are personal computers.

17. A communication system according to claim 10, wherein the communication signal transmitted from the transmitter to the receiver is a wireless communication signal.

18. A communication system which allows only an intended receiver(s) to receive a communication signal from a transmitter(s) in an environment in which a plurality of receivers are capable of receiving a communication signal transmitted from the transmitter, the communication system comprising:

a plurality of first wireless tags for defining a first apparatus location area, and a plurality of second wireless tags for defining a second apparatus location area, each of the first and second wireless tags storing ID information provided according to forward error correction coding, the ID information being an ID segment comprised of one or a plurality of divided sections produced by dividing a predetermined ID;

a transmitter comprising reading means for outputting a wireless ID read signal to read the ID information from each of the first or second wireless tags when the transmitter resides in the first or second apparatus location area, respectively, means for decoding the predetermined ID from the read ID information, and means for multiplexing the decoded ID on a communication signal and transmitting the communication signal; and a receiver comprising reading means for outputting a wireless ID read signal to read ID information from each of the second or first wireless tags when the receiver resides in the second or first apparatus location area, respectively, means for decoding the predetermined ID from the read ID information, means for determining whether or not an ID identical to the decoded ID is multiplexed on a received communication signal, and means for determining that the communication signal is addressed to the receiver when the ID identical to the decoded ID is multiplexed on the received communication signal, wherein a signal from the transmitter residing in one of the first and second apparatus location areas can be received by the receiver residing in the other apparatus location area.

19. A communication system according to claim 18, wherein at least one of the first wireless tags is common to at least one of the second wireless tags, so that the first apparatus location area at least partially overlaps with the second apparatus location area.

20. A communication system according to claim 18, wherein the ID read signal output from the reading means of the respective transmitter and receiver is an infrared signal, an ultrasonic signal, or a radiowave signal, the signal having a low field intensity.

21. A communication system according to claim 18, wherein upon receipt of the ID read signal, the first and second wireless tags output their own ID information in the form of an infrared signal, an ultrasonic signal, or a radiowave signal, the signal having a low field intensity.

22. A communication system according to claim 18, wherein the transmitter and receiver, respectively, are a control apparatus and target apparatus to be controlled thereby.

23. A communication system according to claim 22, wherein the control apparatus and target apparatus are a remote control unit and TV receiver set, respectively.

24. A communication system according to claim 18, wherein the receiver and transmitter are personal computers.

25. A communication system according to claim 18, wherein the communication signal transmitted from the transmitter to the receiver is a wireless communication signal.

26. A communication system which allows only an intended receiver(s) to receive a communication signal from a transmitter(s) in an environment in which a plurality of receivers are capable of receiving a communication signal transmitted from the transmitter, the communication system comprising:

a plurality of first active wireless tags for defining a first apparatus location area, and a plurality of second active wireless tags for defining a second apparatus location area, each of the first and second active wireless tags storing ID information and actively outputting the stored ID information, the ID information being provided according to forward error correction coding, and being an ID segment comprised of one or a plurality of divided sections produced by dividing a predetermined ID;

a transmitter comprising reading means for collecting the ID information from the first or second active wireless tags when the transmitter resides in the first or second apparatus location area, respectively, means for decoding the predetermined ID from the collected ID information, and means for multiplexing the decoded ID on a communication signal and transmitting the communication signal; and a receiver including reading means for collecting ID information from the second or first active wireless tags when the receiver resides in the second or first apparatus location area, respectively, means for decoding the predetermined ID from the collected ID information, means for determining whether or not an ID identical to the decoded ID is multiplexed on a received communication signal, and means for determining that the communication signal is addressed to the receiver when it is determined that the ID identical to the decoded ID is multiplexed on the received communication signal, wherein a signal from the transmitter residing in one of the first and second apparatus location areas can be received by the receiver residing in the other apparatus location area.

27. A communication system according to claim 26, wherein at least one of the first active wireless tags is common to at least one of the second active wireless tags, so that the first apparatus location area at least partially overlaps with the second apparatus location area.

28. A communication system according to claim 26, wherein each the first and second active wireless tag outputs its own ID information in the form of an infrared signal, an ultrasonic signal, or a radiowave signal, the signal having a low field intensity.

29. A communication system according to claim 26, wherein the transmitter and receiver are, respectively, a control apparatus and target apparatus to be controlled thereby.

30. A communication system according to claim 29, wherein the control apparatus and target apparatus are a remote control unit and TV receiver set, respectively.

31. A communication system according to claim 26, wherein the receiver and the transmitter are personal computers.

32. A communication system according to claim 26, wherein the communication signal transmitted from the transmitter to the receiver is a wireless communication signal.

33. A communication system which allows only an intended receiver(s) to receive a communication signal from a transmitter(s) in an environment in which a plurality of receivers are capable of receiving a communication signal transmitted from the transmitter, the communication system comprising:

a plurality of first wireless tags for defining a first apparatus location area, and a plurality of second wireless tags for defining a second apparatus location area, each of the first and second wireless tags storing ID information provided according to forward error correction coding, the ID information being an ID segment comprised of one or a plurality of divided sections produced by dividing a predetermined ID;

a transmitter comprising reading means for outputting a wireless ID read signal to read the ID information of the first or second wireless tags when the transmitter resides in the first or second apparatus location area, respectively, and means for multiplexing the read ID information on a communication signal and transmitting the communication signal; and a receiver comprising reading means for outputting a wireless ID read signal to read ID information of the second or first wireless tags when the receiver resides in the second or first apparatus location area, respectively, first decoding means for decoding the predetermined ID from the read ID information, second decoding means for decoding the predetermined ID using some of the read ID information and the ID information multiplexed on a received communication signal, means for determining whether or not the ID decoded by the first decoding means is identical to the ID decoded by the second decoding means, and means for determining that the communication signal is addressed to the receiver when the determining means determines that the two IDs are identical, wherein a signal from the transmitter residing in one of the first and second apparatus location areas can be received by the receiver residing in the other apparatus location area.

34. A communication system according to claim 33, wherein at least one of the first wireless tags is common to at least one of the second wireless tags, so that the first apparatus location area at least partially overlaps with the second apparatus location area.

35. A communication system according to claim 33, wherein the ID read signal output from the reading means of the respective transmitter and receiver is an infrared signal, an ultrasonic signal, or a radiowave signal, the signal having a low field intensity.

36. A communication system according to claim 33, wherein upon receipt of the ID read signal, each of the first and second wireless tags outputs its own ID information in the form of an infrared signal, an ultrasonic signal, or a radiowave signal having a low field intensity.

37. A communication system according to claim 33, wherein the transmitter and receiver are, respectively, a control apparatus and target apparatus to be controlled thereby.

38. A communication system according to claim 37, wherein the control apparatus and target apparatus are a remote control unit and TV receiver set, respectively.

39. A communication system according to claim 33, wherein the receiver and the transmitter are personal computers.

40. A communication system according to claim 33, wherein the communication signal transmitted from the transmitter to the receiver is a wireless communication signal.

41. A communication system which allows only an intended receiver(s) to receive a communication signal(s) from a transmitter(s) in an environment in which a plurality of receivers are capable of receiving a communication signal transmitted from the transmitter, the communication system comprising:

a plurality of first active wireless tags for defining a first apparatus location area, and a plurality of second active wireless tags for defining a second apparatus location area, each of the first and second active wireless tags storing ID information provided according to forward error correction coding and actively outputting the ID information, the ID information being an ID segment comprised of one or a plurality of divided sections produced by dividing a predetermined ID;

a transmitter comprising means for collecting the ID information from the first or second active wireless tags when the transmitter resides in the first or second apparatus location area, respectively, and means for multiplexing the collected ID information on a communication signal and transmitting the communication signal; and a receiver comprising means for collecting ID information from the second or first active wireless tags when the receiver resides in the second or first apparatus location area, respectively, first decoding means for decoding the predetermined ID from the collected ID information, second decoding means for decoding the predetermined ID using some of the collected ID information and ID information multiplexed on a received communication signal, means for determining whether or not the ID decoded by the first decoding means is identical to the ID decoded by the second decoding means, and means for determining that the communication signal is addressed to the receiver when it is determined that the two IDs are identical, wherein a signal from the transmitter residing in one of the first and second apparatus location areas can be received by the receiver residing in the other apparatus location area.

42. A communication system according to claim 41, wherein at least one of the first active wireless tags is common to at least one of the second active wireless tags, so that the first apparatus location area at least partially overlaps with the second apparatus location area.

43. A communication system according to claim 41, wherein each of the first and second active wireless tags outputs its own ID in the form of an infrared signal, an ultrasonic signal, or a radiowave signal, the signal having a low field intensity.

44. A communication system according to claim 41, wherein the transmitter and receiver are, respectively, a control apparatus and target apparatus to be controlled thereby.

45. A communication system according to claim 44, wherein the control apparatus and target apparatus are a remote control unit and TV receiver set, respectively.

46. A communication system according to claim 45, wherein the receiver and the transmitter are personal computers.

47. A communication system according to claim 41, wherein the communication signal transmitted from the transmitter to the receiver is a wireless communication signal.

* * * * *